United States Patent [19]

Edwards et al.

[11] Patent Number: 4,956,230

[45] **Date of Patent: * Sep. 11, 1990**

[54] INK RECEPTIVE TRANSPARENCY SHEET

[75] Inventors: Donald W. Edwards; Armin J. Paff; Daniel C. Duan, all of St. Paul, Minn.

[73] Assignee: Minnesota Mining and Manufacturing Company, St. Paul, Minn.

[ * ] Notice: The portion of the term of this patent subsequent to Nov. 1, 2005 has been disclaimed.

[21] Appl. No.: 153,486

[22] Filed: Feb. 2, 1988

Related U.S. Application Data

[63] Continuation-in-part of Ser. No. 37,528, Apr. 13, 1987, abandoned.

[51] Int. Cl.[5] ..... B41M 5/00

[52] U.S. Cl. ..... 428/341; 346/135.1; 428/195; 428/412; 428/419; 428/474.4; 428/500

[58] Field of Search ..... 346/14, 135.1; 427/266, 427/288; 428/195, 211, 437.5, 412, 419, 474.4, 500, 340, 341

[56] References Cited

U.S. PATENT DOCUMENTS

| | | | |
|---|---|---|---|
| 4,301,195 | 11/1981 | Mercer et al. | 427/261 |
| 4,371,582 | 2/1983 | Sugiyama et al. | 428/341 |
| 4,460,637 | 7/1984 | Miyamoto et al. | 428/212 |
| 4,481,244 | 11/1984 | Haruta et al. | 428/211 |
| 4,547,405 | 10/1985 | Bedell et al. | 427/256 |
| 4,636,805 | 1/1987 | Toganoh et al. | 428/511 |
| 4,642,247 | 2/1987 | Mouri et al. | 428/215 |
| 4,686,118 | 8/1987 | Arai et al. | 428/522 |
| 4,781,978 | 11/1988 | Duan | 428/328 |

FOREIGN PATENT DOCUMENTS

| | | | |
|---|---|---|---|
| 0125113 | 11/1984 | European Pat. Off. | 428/195 |
| 2050866 | 1/1981 | United Kingdom | 428/195 |
| 2155815 | 10/1985 | United Kingdom | 428/195 |

*Primary Examiner*—Pamela R. Schwartz

*Attorney, Agent, or Firm*—Donald M. Sell; Walter N. Kirn; David L. Weinstein

[57] ABSTRACT

Transparent sheet for use with ink jet printers and pen plotters which utilize hydrophilic solvent-based inks. The sheet comprises a transparent backing bearing on at least one major surface thereof a transparent coating formed of a blend of at least one hydrophilic polymer containing a carbonylamido functional group and at least one hydrophobic polymer substantially free of acidic functional groups, hydroxyl groups, >NH groups and —$NH_2$ groups.

19 Claims, No Drawings

INK RECEPTIVE TRANSPARENCY SHEET

This is a continuation-in-part of application Ser. No. 037,528, filed Apr. 13, 1987, now abandoned.

BACKGROUND OF THE INVENTION

This invention relates to a sheet suitable for preparing transparencies, more particularly, sheet suitable for preparing transparencies by means of various types of ink depositing devices, e.g. ink jet printers and pen plotters.

Ink depositing devices have been developed to serve as means for recording output for computers and the like. Ink jet printers operate by ejecting droplets of ink through a nozzle onto the surface of an appropriate recording medium. Pen plotters operate by writing directly on the surface of an appropriate recording medium, using a pen consisting of a bundle of capillary tubes in contact with an ink reservoir.

Despite the differences in principle of operation between pen plotters and ink jet printers, the properties required of the inks for the two devices are similar. In both devices, the ink must pass through small openings and be exposed to the open air for long periods of time prior to imaging, because it frequently occurs that the printing or plotting device, i.e. nozzle or pen, will be left uncovered while the machine is not in operation, thereby allowing the ink solvent to evaporate. Consequently, the inks must be of low viscosity and must exhibit low evaporation rates at room temperature. Because both types of devices are expected to be used in an office environment, the inks must be of low toxicity, must not produce offensive odors, and must present no fire hazard. An additional requirement arises in the case of a particular type of ink jet printer, known as the "continuous" ink jet printer. This device depends for its operation upon deflecting the ejected ink droplets by means of an electrostatic field. In order to operate in this manner, the ink must be electrically conductive. It has been found by many ink formulators that vehicles comprising water and other water miscible solvents are very useful for meeting these requirements. Even in cases where water is not used, it has been the experience of ink formulators that the best solvents for meeting the above requirements are water miscible. The class of solvents which includes water and water-miscible solvents will hereinafter be referred to as "hydrophilic" solvents.

The primary requirements for ink-receptive sheets which are to be used in the preparation of transparencies are that the imaging material, i.e. the ink, dry quickly thereon and give an acceptable appearance upon projection. Although quick drying is desirable, it is not desirable that the ink solvent evaporate too quickly. If the ink solvents were formulated so as to evaporate extremely quickly, the ink could form a solid mass in the ink-jet orifice or in the pen capillaries, thereby preventing further operation until the apparatus can be cleaned or otherwise repaired. It has been the experience of those who design and build ink jet printers and pen plotters that orifice clogging can be very troublesome and will almost certainly occur if the ink is not formulated so as to avoid excessive evaporation of solvent.

It follows that drying of the printed image should preferably occur by some means other than evaporation. In the case of paper, the absorption of ink into the pores of the paper provides a good means of drying. For non-porous, transparent polymeric sheets, some other means of drying must be used. The quality of print appearance is determined by a number of features, chief among them being color intensity and uniformity, edge smoothness and sharpness, or "acuity", and absence of scratches, fingerprints, or other blemishes in both the image and background areas.

It has been found that color uniformity and intensity are affected by a property called "spread". When ink is deposited onto the imaging medium, it is desirable that it spread over the surface slightly, so that if a solid area is being filled in, the ink being deposited will meet the already deposited portion of the image, so as to form a uniform coloration. On the other hand, it is desired that the ink not spread to such an extent that the edge of the imaged area loses sharpness, or that one color "bleeds" into another. The terms "dot spread" for ink jet printers and "line spread" for pen plotters represent important properties of ink imaging systems.

Another feature of image quality which is of importance is clarity. Some loss of clarity results from haze inherent in the backing or in the coating thereon. Another detriment to clarity results from surface damage, in the form, for example, of scratches or fingerprints. It has been found that ink-receptive layers which are receptive to hydrophilic inks are often susceptible to fingerprints, especially from moist fingers, so that the requirements of good ink receptivity and surface durability can come into conflict. In addition, it has also been found that ink-receptive surface properties important for good drying, high image quality, and good surface durability are affected by ambient relative humidity. The most desirable ink-receptive surface is one which is hydrophilic, i.e., it is capable of absorbing large amounts of water or water-miscible solvents, but not hygroscopic, i.e., it does not absorb excessive quantities of moisture from the air.

U.S. Pat. No. 4,371,582 discloses a coating for ink jet recording sheets which can provide images having good water resistance and high image optical density. The coating disclosed therein is formulated for use with paper substrates. It provides improved image density and permanence by mordanting the dye contained in the ink. It is assumed that the water or other liquid vehicles in the ink will be removed from the image receptive surface by capillary diffusion into the paper substrate, or by some other means. This invention therefore does not address one of the major problems of ink jet printing onto film, namely how to remove the liquid vehicle from the image in order to effect drying.

United Kingdom Patent No. 2050866 discloses a water soluble or swellable polymer as a coating for paper, cloth, plastic film, metal, and glass sheet. The preferred polymer is poly-N-vinyl pyrrolidone; a high concentration of silica and swellable polymer can be added to help imbibe solvent. U.S. Pat. No. 4,547,405 discloses an ink jet recording sheet suitable for making transparencies for overhead projection. The sheet has a layer comprising 5–100% by weight of a coalesced block copolymer latex of polyvinyl alcohol with polyvinyl (benzyl ammonium chloride) and 0–95% by weight of a water soluble polymer selected from the group consisting of polyvinyl alcohol, poly-N-vinyl pyrrolidone and copolymers thereof.

These ink-receptive coatings generally suffer from high moisture sensitivity. They are readily marked by finger contact, are rendered tacky at humidities above 60%, and they stick to the imaging device when fed therethrough.

SUMMARY OF THE INVENTION

This invention provides a sheet material suitable for preparing transparencies comprising a transparent backing bearing on at least one major surface thereof a transparent coating formed of a blend of hydrophilic polymer containing a carbonylamido functional group and at least one hydrophobic polymer substantially free of acidic functional groups, e.g. —COOH groups, hydroxyl groups, >NH groups, and —$NH_2$ groups. By selection of particular hydrophilic and hydrophobic polymers, by varying the ratio of these polymers in the blend, by varying the thickness of the coating formed from a given blend, or by varying both the ratio of polymers in the blend and the thickness of the coating, the imaging properties of the coating can be closely controlled.

The sheet material is clear, transparent, and yields good quality images with hydrophilic inks. In addition, the sheet material is resistant to marking from pressure from moist fingers, resistant to softening in high humidity environments, and capable of providing dry images within four minutes after the ink is applied.

DETAILED DESCRIPTION

Backings that are useful in the practice of the present invention include a variety of polymeric sheet materials transmissive to visible light. Representative examples of polymeric materials suitable for the backing include polyesters, polysulfones, polyimides, polyvinyl chlorides, polycarbonates, polyacrylates, polystyrene, polypropylene, cellophane, cellulose acetate, and cellulose triacetate. A preferred substrate is a polyester film that has been treated with a vinylidene chloride-based polymeric priming agent. The preferred polyester is polyethylene terephthalate.

Coatings that are useful in the practice of this invention are formed from a blend comprising at least one hydrophilic polymeric material and at least one hydrophobic polymeric material, provided that all of the polymeric materials are compatible, further provided that the hydrophobic polymer or polymers are chemically unreactive with the hydrophilic polymer or polymers. The terms "hydrophilic" and "hydrophobic" are used herein in the conventional manner. More particularly, a "hydrophilic" polymer is one which may swell upon exposure to an aqueous fluid and which is permeable to and not a barrier to the fluid. As used herein "aqueous fluid" is a fluid which contains substantial amounts of water. A "hydrophobic" polymer is one which is substantially insoluble and non-swellable in an aqueous fluid. As used herein, the term "compatible" means that the blend formed from the polymeric materials is optically clear. Hydrophilic polymers that are useful for preparing the blends from which the coatings of the present invention are prepared contain N,N-dialkylsubstituted carbonylamido moieties. These polymers include homopolymers, i.e. polymers derived from one specific monomer, and copolymers, i.e. polymers derived from two or more specific monomers. Representative examples of carbonylamido group containing hydrophilic polymers of the blends of the present invention include polymers containing the following carbonylamido groups:

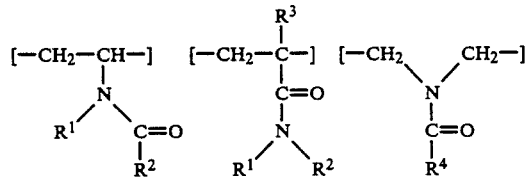

I II III where $R^1$ and $R^2$ independently represent alkyl groups, preferably having from one to eight carbon atoms, more preferably having from one to three carbon atoms, or $R^1$ and $R^2$ together can be represented by $(—CH_2)_x$ where x is an integer from two to five, or $R^2$ can be hydrogen provided that it is bonded to a carbon atom, $R^3$ represents hydrogen or alkyl group having from one to six carbon atoms, and $R^4$ represents hydrogen or alkyl group, preferably having from one to eight carbon atoms, more preferably having from one to three carbon atoms.

If $R^1$, $R^2$, $R^3$, or $R^4$ is an alkyl group, it can be unsubstituted or substituted. If substituted, the nature of the substituents is not critical so long as the blend derived from the polymer is optically clear.

Representative examples of polymers having N,N-dialkylsubstituted carbonylamido moieties and that are suitable for this invention include poly(N-vinylpyrrolidone), poly(N,N-dimethyl acrylamide), poly(ethyloxazoline), poly(N-vinyl caprolactam), and poly(N-vinyl-N-methylacetamide). Preferably, the carbonylamido functional group (—CO—N<) comprises from about 20% to about 60% of the weight of the hydrophilic polymer.

Hydrophobic polymers that are useful for preparing the blends from which the coatings of the present invention are derived are substantially free from acidic functional groups, hydroxyl groups, >NH groups, and —$NH_2$ groups as a component of the repeating unit of the polymer. However, trace quantities of acidic functional groups, hydroxyl groups, >NH groups or —$NH_2$ groups may be present as chain ends or as impurities. It is preferred that the hydrophobic polymers of this invention contain no more than about 1% of acidic functional groups, hydroxyl groups >NH groups or —$NH_2$ groups as impurities.

Representative examples of hydrophobic polymers that are suitable for this invention include poly(vinyl chloride) and copolymers thereof, polyesters, polysulfone resins, poly(benzyl methacrylate), poly(phenyl methacrylate), poly(vinyl cinnamate), poly(acrylonitrile) and copolymers thereof, styrene-acrylonitrile polymers, poly(vinylidene fluoride), and polycarbonate.

Polymeric blends from which the coatings of the articles of this invention are formed can comprise from about 5 to about 99 parts by weight hydrophilic polymer and from about 95 to about 1 part by weight hydrophobic polymer. Preferably, the blends comprise from about 40 to about 95 parts by weight hydrophilic polymer and from about 60 to about 5 parts by weight hydrophobic polymer.

Other materials can be added to the blends from which the coatings of this invention are derived, so long as the resultant coatings are optically clear. Examples of additives suitable for this invention include, but are not limited to, silica, talc, polymeric materials, surfactants, etc.

The coatings formed from the polymeric blends of this invention should be optically clear. A coating is deemed to be optically clear if its haze value is no greater than 10%, as measured in accordance with ASTM D 1003-61 (reapproved 1977) when the weight of the coating is approximately 0.5 g/ft$^2$. Carbonylamido group containing polymers have the surprisingly desirable property of being able to form optically clear blends with a wide variety of hydrophobic polymers.

Representative examples of polymer pairs suitable for coatings of this invention include the following:

| Hydrophobic polymer | Hydrophilic polymer |
|---|---|
| Polysulfone | Poly(N-vinyl pyrrolidone) |
| Polyacrylonitrile | Poly(N-vinyl pyrrolidone) |

Coating compositions can be applied to the backing by means of a knife coater, wire-wound rod, or similar coating method. While coating from solvent is a convenient method of applying the polymeric mixture to the backing, other coating methods, e.g. melt extrusion, can be used.

In the following examples the sheets were evaluated by means of ink jet printer or pen plotter for ink drying time, dot size, edge acuity, and image uniformity.

Ink drying time was determined by pressing a strip of uncoated bond paper against the imaged sheet for about one second with a pressure of about 150 g/cm$^2$. This was repeated at various time intervals until no ink transferred to the paper, and no sticking of paper to sheet occurred. The time interval for the ink on the sheet to reach a state of non-transferrability to the paper was taken as the ink dry time for the sheet sample.

For ink-receptive sheets for ink jet printers, an important parameter with respect to image quality is the dot diameter. Dot diameter was measured with a magnifying device having a known magnification, e.g. a microfilm reader. Dot diameters were measured on the magnified image, and the true dot diameter was then calculated by dividing the dot diameter of the magnified image by the magnification factor.

Color intensity was evaluated by measuring optical density using a MacBeth TD504 transmission densitometer equipped with Status A filters (ANSI PH 2.1-1952(R1969)).

Fingerprint resistance was evaluated by washing the hands with soap and water, followed by complete drying with a paper towel. Two fingers were then moistened with a water dampened paper towel and immediately pressed against the film sample with a force of about 500 grams, divided approximately evenly between the two fingers, for a period of five (5) seconds. The fingerprint impression resulting from this procedure was evaluated by placing the film on an overhead projector and viewing the projected image. If no fingerprint image was visible, the transparency quality was considered excellent. If an impression was visible, the fingerprint resistance was graded very good, good, fair, or poor, depending upon the visibility of the blemish.

In addition to these measurements, an overall subjective evaluation of print quality was made by printing or plotting a test pattern using a commercially available apparatus. The test sheet was then projected onto a standard 60 in.×60 in. screen, by means of an overhead projector. Image evaluation consisted of observing the projected image for overall appearance, with special attention to defects, such as image edge fuzziness or unevenness, nonuniformity of color, running of the color from one area into an area of another color, incomplete merging of dots or lines making up areas of solid fill, and unusual or distracting patterns or textures in the image. Based upon these observations, the print quality for each sample was rated as excellent, good, fair, or poor.

The following non-limiting examples will further illustrate this invention.

EXAMPLE I

Cellulose acetate (CA 394-60SLF, Eastman Chemical Co.) (10 g) was dissolved in a solvent mixture (90 g of a 1:3 ethanol/nitroethane blend) to prepare a solution to blend with a solution containing 10 g of poly(N-vinyl pyrrolidone) (K-90, GAF Company) in 90 g of a 1:3 ethanol/nitroethane solvent blend. The solutions were blended to yield compositions as shown in Table 1.

The compositions were coated at 6 mil wet thickness on 4 mil polyester sheet treated with vinylidene chloride-based polymeric priming agent and dried at 190° F. for 5 minutes. Haze was less than 3%.

Dried films were imaged with a Hewlett Packard HP 85/7475A pen plotter using pens loaded with red and blue glycol-water based inks. The resulting imaged films were evaluated for dry time, image optical density, and overall print quality. The results are shown in Table 1.

TABLE 1

| Amount (% by weight) | | Dry time, seconds | | Image optical density | | Print |
|---|---|---|---|---|---|---|
| CA[1] | PVP[2] | red | blue | red | blue | quality |
| 100 | 0 | 300 | 300 | 0.74 | 1.15 | very poor |
| 80 | 20 | 20 | 10 | 0.92 | 1.32 | poor |
| 60 | 40 | 5 | 5 | 1.27 | 1.59 | fair |
| 50 | 50 | 5 | 5 | 1.44 | 1.73 | good |
| 40 | 60 | 5 | 5 | 1.59 | 1.76 | good |
| 20 | 80 | 5 | 5 | 1.92 | 2.01 | fair |
| 0 | 100 | 600 | 600 | 1.90 | 1.97 | fair |

[1]CA means cellulose acetate.
[2]PVP means poly(N-vinyl pyrrolidone).

The optimum cellulose acetate content was at about 40-50%. At higher cellulose acetate contents the ink did not penetrate the coating readily, resulting in unsatisfactory print quality. At 100% poly(N-vinyl pyrrolidone) content, the ink solvent softened the polymer, giving a slow-drying, tacky image.

These results show that blends of cellulose acetate and polyvinyl pyrrolidone can be used as ink-receptive layers for pen plotters.

EXAMPLE II

Solutions of cellulose acetate (CA 394-60 SLF, available from Eastman Chemical Co.) (10% solids in N,N dimethylacetamide) and poly(N-vinyl pyrrolidone) (K90, available from GAF Company) (10% solids in N,N dimethylacetamide) were blended to give dry coating compositions shown in Table 2. The compositions were coated by a knife coater at 5 mil (125 micrometers) wet thickness on a 4 mil (100 micrometers) polyester sheet treated with vinylidene chloride-based polymeric priming agent. The coatings were dried at 180° F. for 8 minutes to give a coating weight of 0.8 g/ft$^2$. Haze of the coated sheets was less than 3%.

Imaging was performed with a Hewlett-Packard Model 2225B ink jet printer having a droplet volume of 200 picoliters and an addressability of 96 dots per inch. The ink comprised a black acid dye in a solvent containing equal parts of ethylene glycol and water. Transparencies made with this ink-printer system were also tested, and the results are shown in Table 2.

TABLE 2

| Amount (% by weight) CA[1] | PVP[2] | Fingerprint resistance | Dot diameter (μm) | Dry time (sec) | Print quality |
|---|---|---|---|---|---|
| 100 | 0 | Excellent | 62 | No dry | Poor |
| 80 | 20 | Very good | 94 | No dry | Fair |
| 60 | 40 | Good | 110 | 240+ | Good |
| 40 | 60 | Good | 125 | 25 | Very good |
| 0 | 100 | Poor | 125 | 45 | Very good |

[1]CA means cellulose acetate.
[2]PVP means poly(N-vinyl pyrrolidone).

Table 2 shows that a good compromise between dry time and fingerprint resistance occurs at a composition of about 40% cellulose acetate and 60% polyvinyl pyrrolidone.

EXAMPLE III

Solutions containing 10% by weight polyvinyl formal ("Formvar", available from Monsanto Company) in N,N dimethylacetamide were blended with equal weights of solutions containing 10% by weight poly-N-vinylpyrrolidone in N,N-dimethylacetamide. Three grades of "Formvar" polymer were used. The blended solutions were coated at 4 mil wet thickness on unprimed polyethylene terephthalate sheet (4 mil, 100 micrometers). Coatings were dried for 8 minutes at 180° F. and tested with the ink jet printer described in Example II. Results are shown in Table 3.

TABLE 3

| Grade of PVF[1] | Fingerprint resistance | Dot diameter (μm) | Dry time (sec) | Print quality |
|---|---|---|---|---|
| "Formvar" 7/75 | good | 155 | 50 | good |
| "Formvar" 12/85 | good | 155 | 30 | good |
| "Formvar" 5/95 | good | 170 | 60 | good |

[1]PVF means polyvinylformal
All of the blends showed good fingerprint resistance and print quality.

EXAMPLE IV

Mixtures of polysulfone ("Udel 1700", available from Union Carbide Corp.) and poly(N-vinyl pyrrolidone) (K90, available from GAF Corporation) were blended and coated on polyester sheet by means of the same blending and coating procedure as in Example III. Coating weights were about 0.8 g/ft$^2$, and tests were conducted on the ink jet printer used in Example II. The results are shown in Table 4.

TABLE 4

| Amount (% by weight) PS[1] | PVP[2] | Fingerprint resistance | Dot diameter (μm) | Dry time (sec) |
|---|---|---|---|---|
| 35 | 65 | good | 220 | 180 |
| 30 | 70 | fair | 185 | 60 |
| 25 | 75 | fair | 185 | 35 |

[1]PS means polysulfone.
[2]PVP means poly(N-vinyl pyrrolidone).

The shortest dry time was at a ratio of 25% by weight polysulfone to 75% by weight poly(N-vinyl pyrrolidone).

EXAMPLE V

Polyethyloxazoline (10 parts "PEOX 500", available from Dow Chemical Co.) was dissolved in dimethyl acetamide (90 parts) and the solution was blended with a phenoxy resin solution (10 parts "Phenoxy PKHC" resin, available from Union Carbide Corp., in 90 parts N,N-dimethylacetamide) to give a coating solution containing equal parts of each polymer. The solution was coated onto 4 mil polyethylene terephthalate sheet by means of a knife coater to a weight of about 1 g/ft$^2$. The resulting coating was optically clear (haze was less than 3%) and had good fingerprint resistance. The black ink comprising a solvent containing water and ethylene glycol of Example II and the ink jet printer of Example II was used to test the sheet. The ink dried in about 30 seconds and gave a dot diameter of 155 micrometers.

EXAMPLE VI

Poly(N,N dimethylacrylamide) (PDMA) (Catalog No. 4590, available from Polysciences, Inc.) was dissolved in N,N-dimethyl acetamide to form a 10% solution. Blends were made with equal amounts of phenoxy resin ("Phenoxy PKHC", available from Union Carbide Corp.), of cellulose acetate (CA 394–60 SLF, available from Eastman Products Co ), and of styrene-acrylonitrile ("Tyril 1000", available from Dow Chemical Co.). These blends were coated at 1 g/ft$^2$ dry weight on polyester to give clear sheets. The results of tests with the ink jet printer used in Example II are shown in Table 5.

TABLE 5

| Components of blend | Dry time (sec) | Dot diameter (μm) | Print quality |
|---|---|---|---|
| phenoxy resin/PDMA | 180 | 180 | good |
| cellulose acetate/PDMA | 180 | 180 | good |
| styrene-acrylonitrile/PDMA | 180 | 125 | good |

Print quality was good and the sheets could be handled without fingerprinting.

EXAMPLE VII

Coating compositions were prepared by blending polyethyloxazoline ("PEOX 500", available from Dow Chemical Co.) with the polymers in the following table. The coating solvent was N,N-dimethylacetamide. The compositions contained equal amounts of polyethyloxazoline and the second polymer. The compositions were coated by means of a knife coater set at a 5 mil orifice onto 4 mil polyester sheet and dried as in Example I. The coated sheets were tested with the ink jet printer used in Example II, the ink solvent being a blend of water and ethylene glycol. The results are shown in Table 6.

TABLE 6

| Components of blend | Fingerprint resistance | Dot size (μm) | Dry time (sec) |
|---|---|---|---|
| Nitrocellulose (Hercules, Inc.)/polyethyloxazoline | good | 120 | 240+ |
| Polyvinyl methyl ether/maleic anhydride copolymer ("Gantrez 169", GAF Company)/ polyethyloxazoline | good | 190 | 240+ |
| Poly(vinylidene chloride-acrylonitrile) ("Saran F 310", Dow | good | 185 | 240+ |

TABLE 6-continued

| Components of blend | Fingerprint resistance | Dot size (μm) | Dry time (sec) |
|---|---|---|---|
| Chemical Co.)/ polyethyloxazoline | | | |
| Poly(vinyl chloride) (VAGH, Union Carbide Corp.)/polyethyloxazoline | good | 170 | 120 |
| Phenoxy resin (PKHC, Union Carbide Corp.)/ polyethyloxazoline | good | 180 | 240+ |
| Cellulose acetate butyrate (Eastman EASB, Eastman Chemical Co.)/ polyethyloxazoline | good | 110 | 240+ |
| Styrene-acrylonitrile copolymer ("Tyril 1000", Dow Chemical Co.)/ polyethyloxazoline | good | 120 | 240+ |

As seen in Table 6, the only blend that resulted in acceptable drying time was the one containing polyvinyl chloride. This demonstrates that the hydrophobic polymer in the blend can play an important role in dry time.

EXAMPLE VIII

A series of coatings of polyethyloxazoline ("PEOX 500", available from Dow Chemical Co.) with phenoxy resin ("PKHC", available from Union Carbinde Corp.), varying the weight ratio of the polymers, was made according to a procedure similar to that of Example VII. The results are shown in Table 7.

TABLE 7

| Amount (% by weight) | | | | |
|---|---|---|---|---|
| phenoxy | polyethyl-oxazoline | Fingerprint resistance | Dot diameter (μm) | Dry time (sec) |
| 40 | 60 | good | 180 | 40 |
| 30 | 70 | good | 155 | 30 |
| 20 | 80 | fair | 155 | 30 |

EXAMPLE IX

This example shows that the hydrophobic component of the blend may be a latex dispersion, rather than a polymer solution. A blend was prepared by adding an aqueous solution of poly(N-vinyl pyrrolidone) (K90, available from GAF Company) to a latex dispersion of polyester (WNT, available from Eastman Chemical Products, Inc., 25% by weight solids). For purposes of comparison, a second blend was prepared by adding polyvinyl alcohol to the polyester latex dispersion. Finally, an aqueous solution of polyvinyl alcohol ("Vinol 540", available from Air Products and Chemicals, Inc.) was added to a blend of the polyester latex dispersion and poly(N-vinyl pyrrolidone). The concentrations of the polymers in the solutions and the amounts of said solutions added to the latex dispersion were chosen so as to obtain the dry weight proportions of the resulting blends shown in Table 8.

The solution-dispersion blends were coated onto 4 mil clear polyethylene terephthalate sheet by means of a knife coater having a 7 mil orifice. The coatings were oven dried for eight minutes at 190° F. For the three compositions shown in Table 8, the resulting dry coating weight was 1.0 g/ft$^2$. All three compositions exhibited good fingerprint resistance and had haze values of less than 3%. Printability evaluations were conducted on a Xerox Model 4020 ink jet printer using glycol-water-dye inks.

TABLE 8

| Amount (% by weight) | | | Dry time | |
|---|---|---|---|---|
| PL[1] | PVA[2] | PVP[3] | (min) | Print quality |
| 40 | 60 | 0 | 60 | fair/poor |
| 40 | 0 | 60 | 10 | good |
| 40 | 30 | 30 | 3 | good |

[1]PL means polyester latex dispersion
[2]PVA means polyvinyl alcohol
[3]PVP means Poly(N-vinyl pyrrolidone)

The data in Table 8 demonstrate that satisfactory results can be obtained from polymer blends wherein the hydrophobic polymer is in the form of a latex dispersion in water, rather than in the form of a solution. The data in Table 8 further show that use of a polyvinyl alcohol additive in the polyester-poly(vinyl pyrrolidone) blend can result in significantly shorter dry time.

By using the latex dispersion for the hydrophobic component of the blend, the only solvent needed is water. This greatly minimizes the hazards of toxicity, fire, and adverse environmental impact.

Various modifications and alterations of this invention will become apparent to those skilled in the art without departing from the scope and spirit of this invention, and it should be understood that this invention is not to be unduly limited to the illustrative embodiments set forth herein.

What is claimed is:

1. Transparent sheet consisting of a polymeric backing bearing on at least one major surface thereof an ink receptive layer comprising a blend of at least one hydrophobic polymer substantially free of acidic functional groups, hydroxyl groups, >NH groups, and —$NH_2$ groups and at least one hydrophilic polymer containing carbonylamido groups, said carbonylamido groups selected from the group consisting of

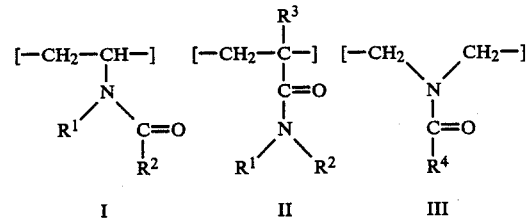

I II III where $R^1$ and $R^2$ independently represent alkyl groups, or $R^1$ and $R^2$ together can be represented by $(—CH_2—)_x$ where x is an integer from two to five, or $R^2$ can be hydrogen provided that it is bonded to a carbon atom, $R^3$ represents hydrogen or alkyl group having from one to six carbon atoms, and $R^4$ represents hydrogen or alkyl group, said layer capable of receiving aqueous-based inks.

2. The sheet of claim 1 wherein said backing is transmissive to visible light.

3. The sheet of claim 1 wherein $R^1$ contains from 1 to 8 carbon atoms.

4. The sheet of claim 3 wherein $R^1$ represents an alkyl group having 1 to 3 carbon atoms.

5. The sheet of claim 1 wherein $R^2$ contains from 1 to 8 carbon atoms.

6. The sheet of claim 5 wherein $R^2$ represents an alkyl group having 1 to 3 carbon atoms.

7. The sheet of claim 1 wherein $R^4$ contains from 1 to 8 carbon atoms.

8. The sheet of claim 7 wherein $R^4$ represents an alkyl group having 1 to 3 carbon atoms.

9. The sheet of claim 1 wherein said hydrophobic polymer is selected from the group consisting of polyesters, homopolymers and copolymers of vinyl chloride, polysulfone resins, polyacrylonitrile and copolymers thereof, poly(benzyl methacrylate), poly(phenyl methacrylate), poly(vinyl cinnamate), poly(vinylidene fluoride), and polycarbonate.

10. The sheet of claim 9 wherein said hydrophobic polymer is a polyester.

11. The sheet of claim 9 wherein said hydrophobic polymer is a polysulfone.

12. The sheet of claim 9 wherein said hydrophobic polymer is a poly(vinyl chloride).

13. The sheet of claim 1 wherein said hydrophilic polymer is selected from the group consisting of poly(N-vinyl pyrrolidone), poly(N,N-dimethyl acrylamide), poly(methyloxazoline), poly(ethyloxazoline), poly(N-vinyl valerolactam), poly(N-vinyl caprolactam), and poly(N-vinyl N-methyl acetamide).

14. The sheet of claim 13 wherein said hydrophilic polymer is poly(N-vinyl pyrrolidone).

15. The sheet of claim 1 wherein said hydrophilic polymer comprises from about 5 to about 99 parts by weight of the blend and said hydrophobic polymer comprises from about 95 to about 1 part by weight of the blend.

16. The sheet of claim 1 wherein said hydrophilic polymer comprises from about 40 to about 95 parts by weight of the blend and said hydrophobic polymer comprises from about 60 to about 5 parts by weight of the blend.

17. The sheet of claim 1 wherein said carbonylamido functional group comprises from about 20% to about 60% by weight of the hydrophilic polymer.

18. The sheet of claim 1 wherein said ink-receptive layer has a coating weight of no less than 0.2 grams per square foot.

19. The sheet of claim 1 wherein said ink-receptive layer has a coating weight less than or equal to 2.0 grams per square foot.

* * * * *